United States Patent [19]

Aschaber et al.

[11] Patent Number: 5,067,937

[45] Date of Patent: Nov. 26, 1991

[54] SYSTEM FOR ERECTING CARTONS

[75] Inventors: Hans Aschaber; Rudolf Bailer, both of Laupheim; Fritz Fochler, Senden; Bernd Kleinstäuber, Burgrieden; Reinhold Ruf, Laupheim, all of Fed. Rep. of Germany

[73] Assignee: Uhlmann Pac-Systeme GmbH & Co. KG, Laupheim, Fed. Rep. of Germany

[21] Appl. No.: 583,374

[22] Filed: Sep. 14, 1990

[30] Foreign Application Priority Data

Sep. 14, 1989 [DE] Fed. Rep. of Germany ..... 3930720

[51] Int. Cl.[5] ..... B31B 5/78; B31B 5/80

[52] U.S. Cl. ..... 493/310; 493/315

[58] Field of Search ..... 493/310, 315, 317, 318

[56] References Cited

U.S. PATENT DOCUMENTS

| | | | |
|---|---|---|---|
| 3,242,827 | 3/1966 | Winters | 493/315 |
| 3,633,470 | 1/1972 | Bingham | 493/310 |
| 4,194,442 | 3/1980 | Martelli | 493/315 |
| 4,211,153 | 7/1980 | Walters et al. | 493/310 |
| 4,596,545 | 6/1986 | Greenwell | 493/315 |
| 4,871,348 | 10/1989 | Konaka | 493/315 |
| 4,881,934 | 11/1989 | Harston et al. | 493/315 |

FOREIGN PATENT DOCUMENTS

| | | | |
|---|---|---|---|
| 326980 | 1/1958 | Switzerland | 493/315 |

*Primary Examiner*—William E. Terrell

*Attorney, Agent, or Firm*—Herbert Dubno; Andrew M. Wilford

[57] ABSTRACT

A system for erecting boxes has a magazine holding supply of flattened boxes having panels separated at respective fold lines, a support wheel generally continuously rotating about an axis adjacent the supply, a grab on the support wheel, an unfolder on the wheel adjacent the grab, and a conveyor adjacent the wheel. The grab and the unfolder are pivotal on the wheel about a grab axis parallel to the wheel axis and defining thereabout an orbit and the conveyor has upper and lower elements defining parallel and vertically spaced upper and lower conveyor planes, and front and rear elements displaceable parallel to the planes therebetween and defining respective conveyor calls. The upper plane is generally tangent to the orbit of the grab axis. A box is engaged with the grab and with the unfolder which are then relatively pivoted about the grab axis until the box is erected and an upper panel of the erected box engaged by the grab extends parallel to the upper conveyor plane but is spaced above the upper conveyor plane. Thereafter the grab and unfolder are synchronously pivoted about the grab axis while rotating the wheel to maintain the upper panel of the box parallel to the upper conveyor plane until the upper panel lies generally on the upper conveyor plane. The box is then released from the grab into a respective cell of the conveyor.

12 Claims, 8 Drawing Sheets

SYSTEM FOR ERECTING CARTONS

FIELD OF THE INVENTION

The present invention relates to a system for erecting cartons. More particularly this invention concerns taking flattened but fold-scored cartons out of a magazine and delivering them in set-up condition to a conveyor.

BACKGROUND OF THE INVENTION

Cartons or boxes are typically delivered to the user flat and formed with fold lines that permit them easily to be erected into the desired rectangularly parallelepipedal shape. In a standard box-erecting apparatus the flat boxes are held in a stack in a magazine from which they are pulled one at a time by a suction grab. An unfolder engages another panel of the box and erects it, and the erected box is deposited in a respective cell of a conveyor that itself comprises a top rail, a bottom rail, and a succession of cell-defining elements that move along between and parallel to the rails. A filling apparatus down-stream of the box-erecting system loads the necessary contents into the boxes in the cells, and other devices may be provided to fold in end flaps and seal the boxes.

As described in German patent document 2,923,909 filed June 13, 1979 by Otto Weller such an apparatus has a support wheel for the grab and for the unfolder. A parallelogrammatic linkage carries these elements so that even though the wheel moves continuously, the grab's angular movement can be temporarily canceled out for the necessary pickup transfer during which the grab effectively is moved only radially inward on the wheel. Once picked up the box is brought up to the peripheral speed of the wheel as it is erected and is then passed off to the conveyor whose transport speed is equal to the wheel's peripheral speed. Once the erected box is set in its cell in the conveyor, the suction grab releases it and this grab retracts radially back into the wheel, out of the way, while the unfolder is moved back to its starting position.

In this arrangement the box is handed by the wheel off to the conveyor before it is fully erected, that is with adjacent panels perfectly perpendicular to each other, because otherwise parts of the unfolder would bump parts of the conveyor. The last stage of the unfolding operation is therefore carried out by the conveyor. As a result exact positioning of the box is impossible and the box will tend by its own elasticity to return somewhat to the flattened condition. The faster the downstream equipment operates, the more this inexactitude is a problem.

OBJECTS OF THE INVENTION

It is therefore an object of the present invention to provide an improved system for erecting a box and feeding it to a conveyor.

Another object is the provision of such an improved system for erecting a box and feeding it to a conveyor which overcomes the above-given disadvantages, that is which completely sets up the box, overcoming its own shape memory, and that accurately positions it on the conveyor.

SUMMARY OF THE INVENTION

A system for erecting boxes according to the invention has a magazine holding supply of flattened boxes having panels separated at respective fold lines, a support wheel generally continuously rotating about an axis adjacent the supply, a grab on the support wheel, an unfolder on the wheel adjacent the grab, and a conveyor adjacent the wheel. The grab and the unfolder are pivotal on the wheel about a grab axis parallel to the wheel axis and defining thereabout an orbit and the conveyor has upper and lower elements defining parallel and vertically spaced upper and lower conveyor planes, and front and rear elements displaceable parallel to the planes therebetween and defining respective conveyor cells. The upper plane is generally tangent to the orbit of the grab axis. In accordance with this invention a box is engaged with the grab and with the unfolder which are then relatively pivoted about the grab axis until the box is erected and an upper panel of the erected box engaged by the grab extends parallel to the upper conveyor plane but is spaced above the upper conveyor plane. Thereafter the grab and unfolder are synchronously pivoted about the grab axis while rotating the wheel to maintain the upper panel of the box parallel to the upper conveyor plane until the upper panel lies generally on the upper conveyor plane. The box is then released from the grab into a respective cell of the conveyor.

Thus according to the invention the box is completely erected before being deposited into its cell in the output conveyor. Only after being completely erected is the box moved through an arc while being maintained in perfect alignment with the output conveyor. In the last stages as the box is fitted to the bottom and front elements of the conveyor, the unfolder is pivoted out of the way and the rear element of the conveyor pivots up to engage the rear panel of the box and carry it away. The pivot axis for the grab and unfolder lies on the fold line that trails in the wheel-rotation direction the panel of the box engaged by the grab. There is no possibility of the unfolder and grab sliding on the respective panels of the box due to this orientation.

According to a feature of this invention the grab and unfolder are first relatively pivoted through more than 90° to overbend the box and then are set at a position 90° offset from another as the box is deposited in the conveyor. This action overcomes the natural elasticity of the box so that it can stand without support in the desired 90° erect position.

In accordance with a further feature of the invention the conveyor elements have upstream ends and the upstream end of the upper conveyor element is downstream in a conveyor transport direction from the upstream end of the lower conveyor element. This spacing is equal to at least one horizontal box length.

The pivoting of the grab during transfer to the conveyor can be such that the front box panel lies in every position with its leading edge just at the level of the lower conveyor plane so that the fold line slides on the lower conveyor element. It is simpler according to this invention when the grab in the last part of deposition arc is maintained parallel to the upper plane of the conveyor. As the wheel continues to turn the box then moves forward and down only, with no pivotal action except relative to the rotating wheel.

According to another feature of this invention the grab and the unfolder have elements defining respective support planes extending to immediately adjacent the grab axis. In addition the wheel is provided with a plurality of such grabs angularly equispaced about the wheel axis and adjacent each grab with a respective unfolder. The wheel is provided with a grab axle and with an unfolder axle in turn provided with respective arms carrying the grab and unfolder and provided with cranks constituting part of the structure. The crank of one of the axles includes a tubular shaft and the crank of the other axle includes a shaft received in the tubular shaft and coaxial therewith and the arms are axially displaceable on the respective axles. The control structure is a cam fixed adjacent the wheel.

DESCRIPTION OF THE DRAWING

The above and other objects, features, and advantages will become more readily apparent from the following, reference being made to the accompanying drawing in which.

Figure 2:
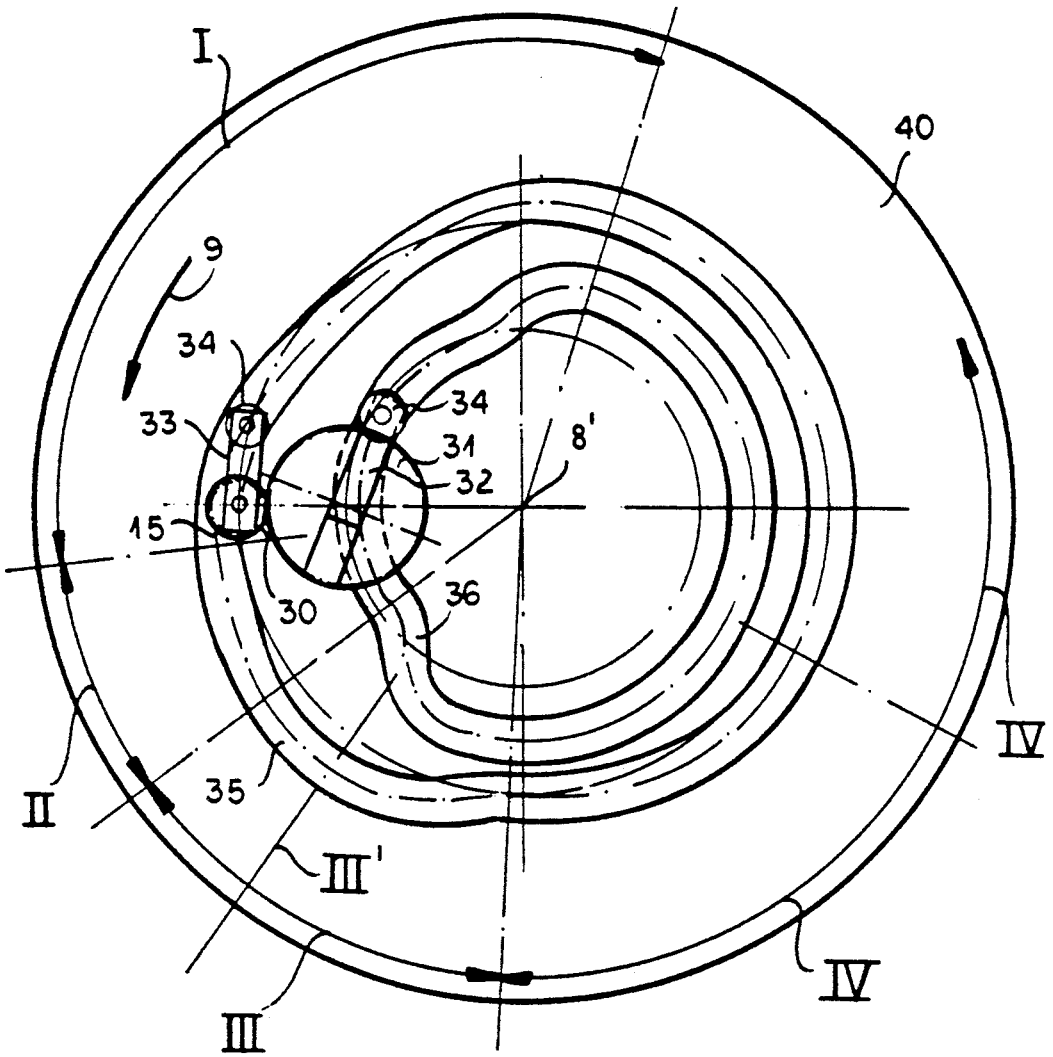
FIG. 2 is an end view of the cam and associated structure for operating the system of FIG. 1.
Figure 3A:
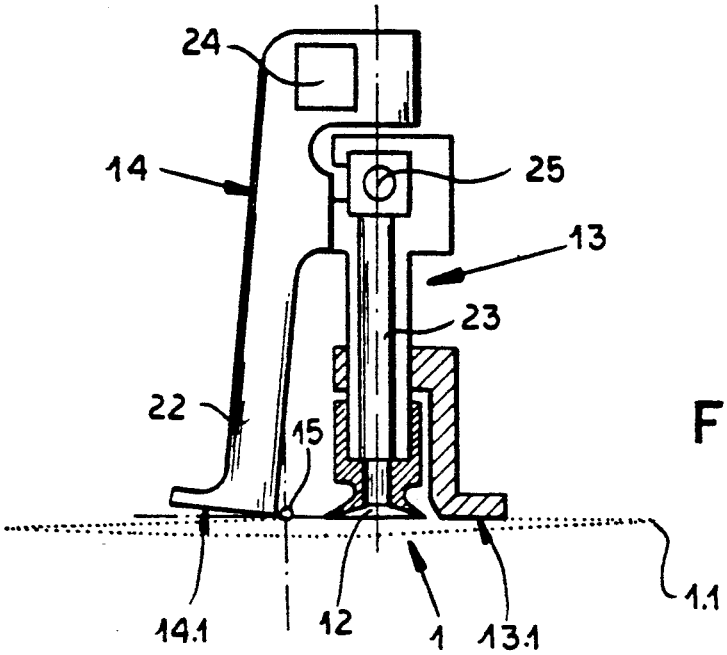
Figure 3B:
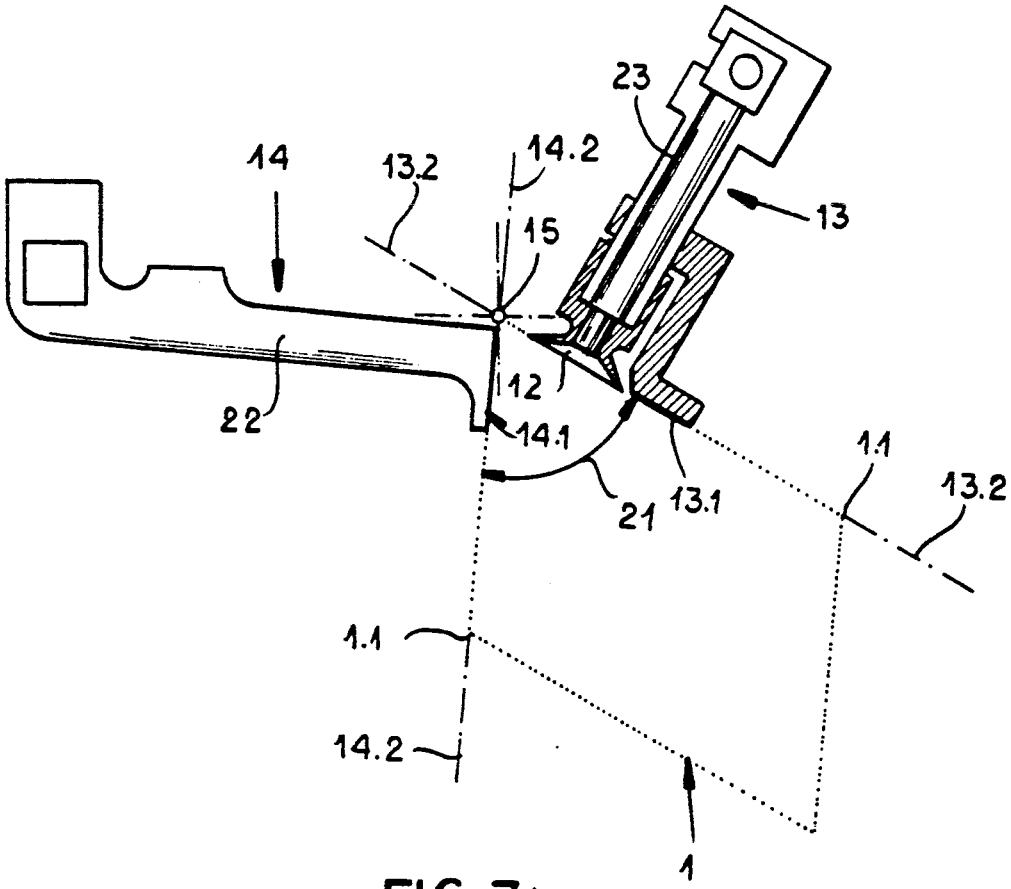
Figure 3C:
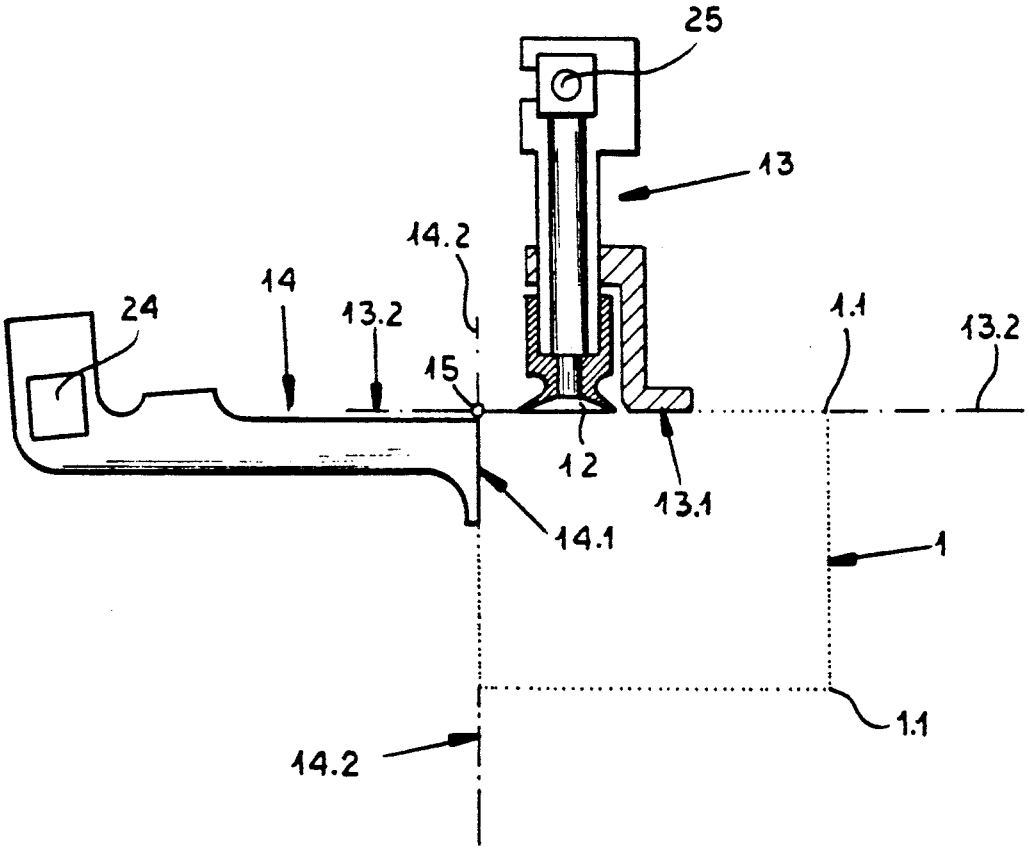
Figure 4A:
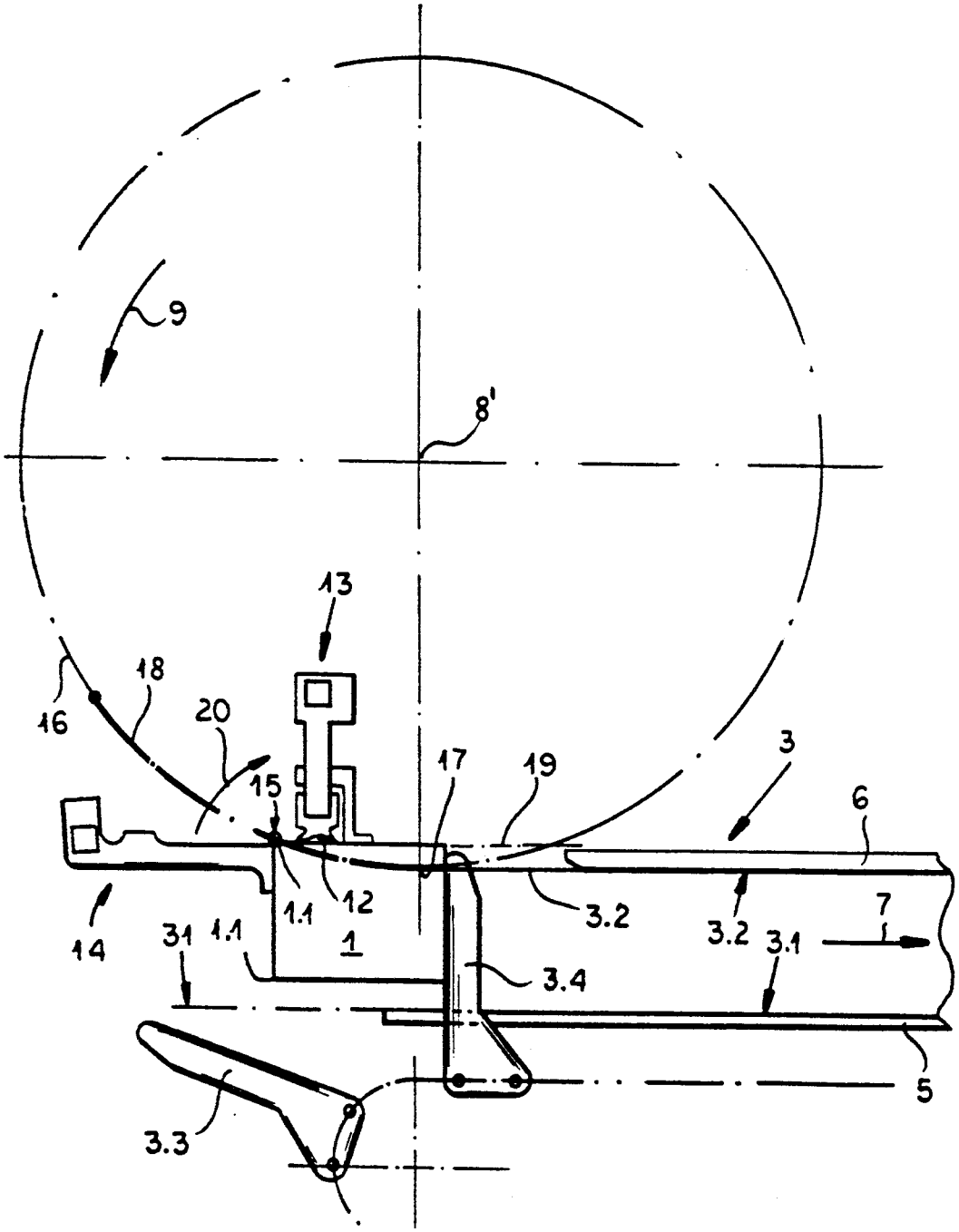
Figure 4B:
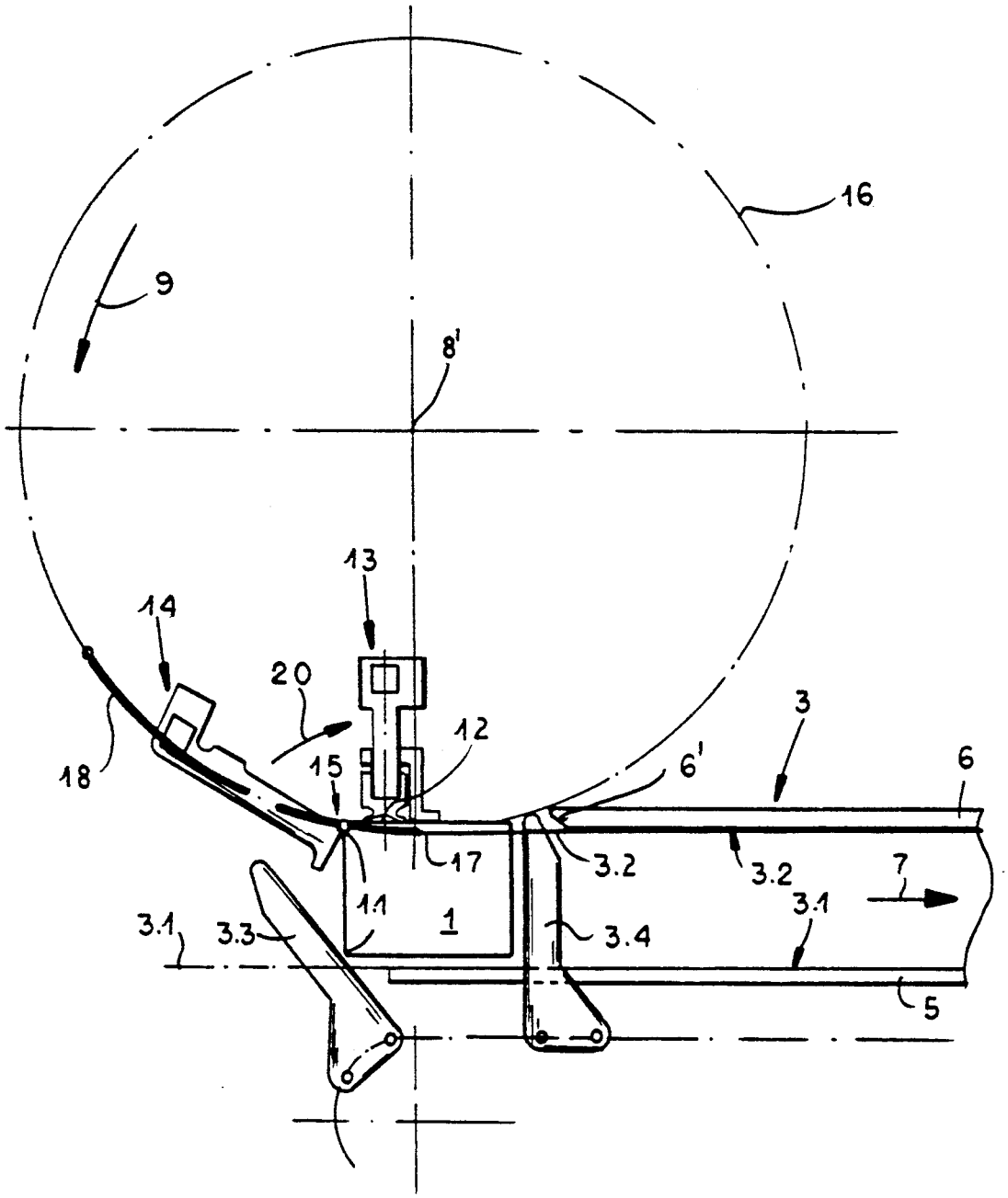
Figure 4C:
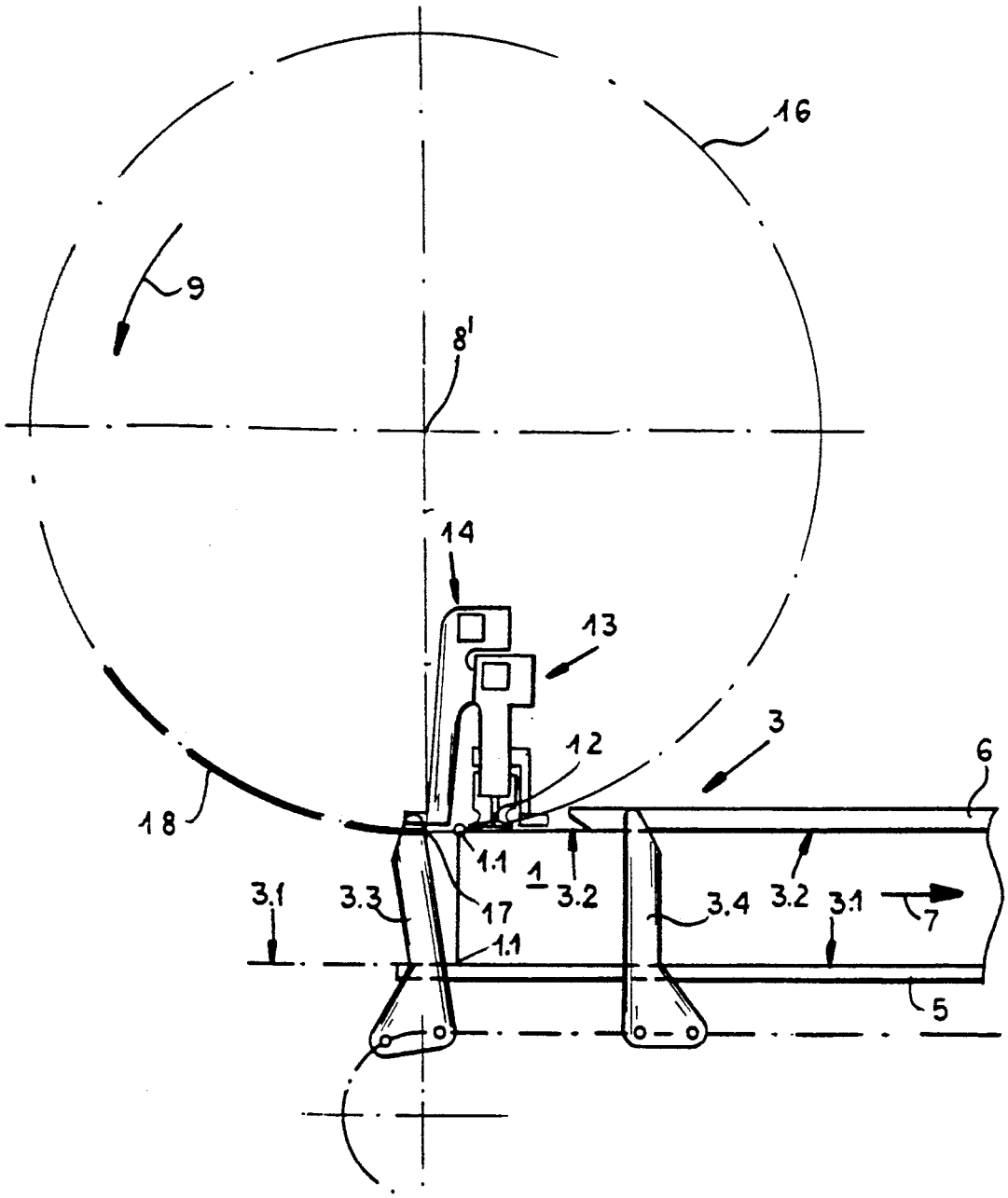
Figure 5:
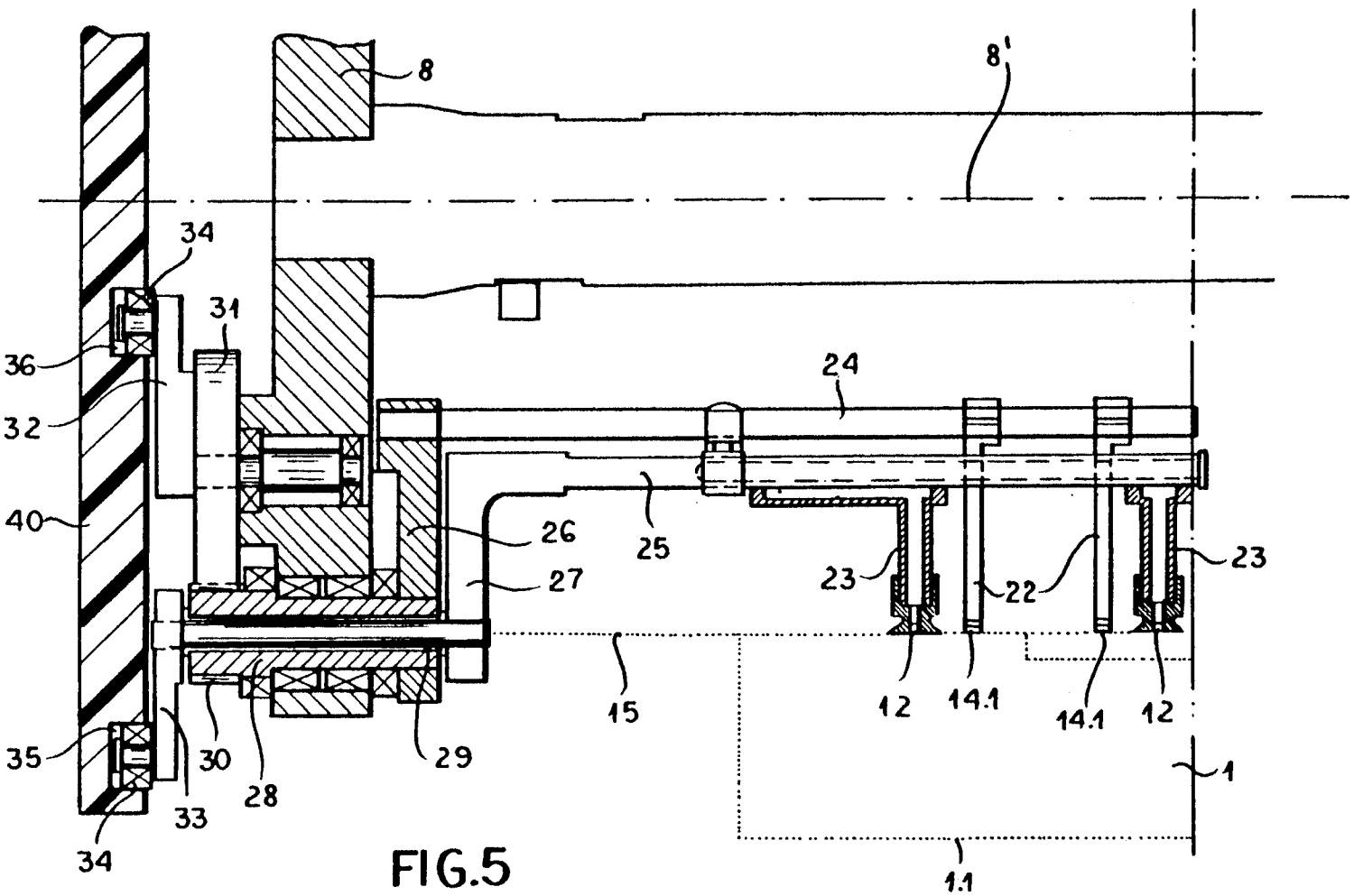

FIGS. *3a*, *3b*, and *3c* are end views illustrating operation of the carton erector as it receives and sets up a carton;

FIGS. *4a*, *4b*, and *4c* are end views illustrating how the system delivers a set-up carton to the conveyor; and FIG. 5 is a sectional view showing the structure that interconnects the carton erector with the cam of FIG. 2.

SPECIFIC DESCRIPTION

Figure 1:
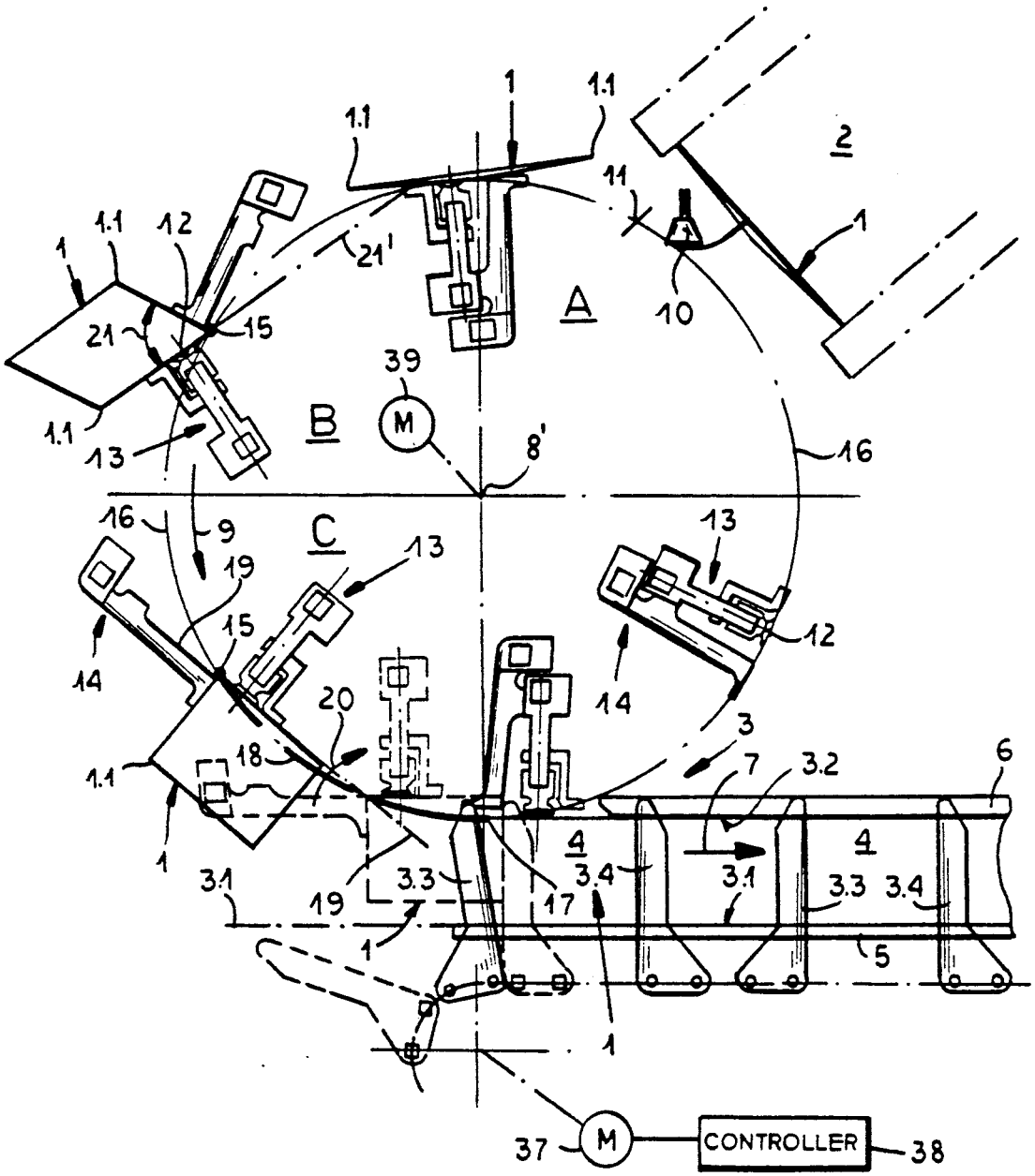
FIG. 1 is a partly diagrammatic end view of the carton-erecting system of this invention.

As seen in FIG. 1 a stack of flattened boxes or cartons 1 formed with parallel score lines 1.1 is held in a magazine 2 located above a conveyor indicated generally at 3. This conveyor 3 is defined between horizontal lower and upper planes 3.1 and 3.2 and in turn defines horizontally spaced cells 4 between pivotal leading elements 3.3 and trailing elements 3.4. The lower plane 3.1 is defined by a rail 5 and the upper plane 3.2 by a rail 6. A drive 37 operated by a controller 38 advances the elements 3.3 and 3.4 and the cells 4 defined thereby in a horizontal transport direction 7. The horizontal spacing between adjacent elements 3.3 and 3.4 corresponds to the length of the boxes to be held in the cells 4.

A wheel 8 is rotated about an axis 8' that is horizontal, parallel to the fold lines 1.1, and perpendicular to the direction 7 in an angular direction 9 by a drive 39 also connected to and operated by the controller 38. Flattened boxes 1 are pulled out of the magazine 2 by a transfer device shown partially schematically at 10 and are delivered at 11 to successive suction grippers 12 of grabs 13 of the wheel 8.

Associated with each grab 13 is an unfolder 14. Each grab 13 has an element 13.1 defining a grab plane 13.2 and each unfolder 14 has an element 14.1 defining a folding plane 14.2 meeting the respective grab plane 13.2 at a line 15 between the grab 13 and unfolder 14 and coinciding with a fold line 1.1 of a box 1 held by the respective grab 13. The box 1 is first picked up in a pickup sector or station A as seen in FIG. *3a*, then is overfolded in a sector or station B by relative pivoting of the devices 13 and 14 on the wheel 8 about the axis 15 as seen in FIG. *3b*, and then is passed in a transfer sector or station C to the conveyor 3.

During the pivoting of the elements 13.1 and 14.1 about the axis A, there is no sliding of the respective panels of the respective box 1 on them since the axis 15 lies on the fold line between the two engaged box panels. During orbiting of a box the axis 15 describes a circle 16 which tangents the upper plane 3.2 of the conveyor 3 at 17 at its lowermost point, at the end of a transfer arc 18 shown in FIG. 1 in a heavy dot-dash line. As the unfolder 13 moves through the region corresponding to this circular arc 18 its plane 13.2 lies on a secant 19 that crosses the circle 16 at the axis 15 and at another location upstream in the direction 9 from this axis 15. As the unfolder 13 moves through this arc 18 it is pivoted until the line 19 is merely tangent to the circle 16 at the axis 15 when this axis 15 reaches the point 17 where the circle 16 tangents the plane 3.2.

FIG. *3b* further illustrates how in the station B the box 1 is overfolded, that is it is bent past a purely right-angle position by bending adjacent panels at the axis 15 to an acute angle 21 so that a secant 21' (FIG. 1) defined by the plane 13.1 intersects the circle 16 behind the axis 15 in the direction 9. This overfolding overcomes the natural elasticity of the material of the box 1 so that when released it remains as much as possible in a right-angle position as indicated in FIG. *3c*.

FIGS. *4a* through *4c* show the transfer of the set-up box 1 from the wheel 8 to the conveyor 3. First as seen in FIGS. *4a* the leading face of the box abuts the respective leading cell element 3.4. Thereafter continued rotation of the wheel 8 is synchronized with continued pivoting of the grab 13 and unfolder 14 so as to maintain the plane 13.2 parallel to the plane 3.2 so that the erected box 1 moves downward and in the direction 7 simultaneously as indicated by a comparison of FIGS. *4a* and *4b*. Finally as seen in FIG. *4c* in the last stages of the transfer the unfolder 14 is swung up out of the way as indicated by arrow 20 and the trailing cell element 3.3 pivots up to engage the rear face of the box 1 which slips under the upper rail 6 and is released from the grab 13. The top rail 6 has an upstream end somewhat downstream of the point 17 to permit this transfer, and its lower edge is beveled at 6' to engage the box 1 and ensure that it feeds down correctly.

FIGS. 2 and 5 illustrate how the grab 1 and unfolder 14 are mounted on the free outer ends of respective arms or fingers 22 and 23 whose inner ends are fixed to respective rods 24 and 25 in turn carried on the outer ends of respective cranks 26 and 27 pivoted on respective axles 28 and 29 themselves centered on the axis A, with the axle 28 being tubular and surrounding the axle 29. The outer end of the axle 28 is connected through gearing 31 to a crank 32 whose outer end in turn carries a cam-following roller 34 riding in an outer cam groove 36 of a cam 40 and the outer end of the axle 29 carries a crank 33 whose outer end carries another such roller 34 in another groove 35 of the cam 40. The grooves 35 and 36 are annular and noncircular and the groove 36 lies within the groove 35.

The cam 40 as seen in FIG. 2 is subdivided in to a sector I centered on the axis 8' and corresponding to the zone where the box 1 is broken open and overfolded. In a following zone II the box is fully erected. In a following zone III, which corresponds to the arc 18 of FIG. 1, the fully erected box is swung around until at a point III' it is parallel to the cell 4 that is to receive it. This parallel position is maintained until the end of sector III when the box 1 is transferred. In sector IV the grab 13 and unfolder 14 are returned to their ready positions with the planes 13.2 and 14.2 coplanar to receive a new flattened box 1 from the unillustrated transfer device.

We claim:

1. A method of operating a system for erecting boxes, the system comprising:

a supply of flattened boxes having panels separated at respective fold lines;

a support wheel generally continuously rotating about an axis adjacent the supply;

a grab on the support wheel;

an unfolder on the wheel adjacent the grab, the grab and the unfolder being pivotal on the wheel about a grab axis parallel to the wheel axis and defining thereabout an orbit; and a conveyor adjacent the wheel having upper and lower elements defining parallel and vertically spaced upper and lower conveyor planes, and front and rear elements displaceable parallel to the planes therebetween and defining respective conveyor cells, the upper plane being generally tangent to the orbit of the grab axis, the method comprising the steps of sequentially:

a) engaging a box with the grab and with the unfolder;

b) pivoting the grab and unfolder about the grab axis until the box is erected and an upper panel of the erected box engaged by the grab extends parallel to the upper conveyor plane but is spaced above the upper conveyor plane;

c) synchronously pivoting the grab and unfolder about the grab axis after erecting the box and while rotating the wheel to maintain the upper panel of the box parallel to the upper conveyor plane until the upper panel lies generally on the upper conveyor plane; and d) releasing the box from the grab into a respective cell of the conveyor.

2. The box-erecting method defined in claim 1 wherein in step b) the grab and unfolder are first relatively pivoted through more than 90° to overbend the box and then are set at a position 90° offset from another during step c).

3. A system for erecting boxes, the system comprising:

a magazine holding a supply of flattened boxes having panels separated at respective fold lines;

a support wheel rotatable about an axis adjacent the supply;

a grab on the support wheel;

an unfolder on the wheel adjacent the grab, the grab and the unfolder being pivotal on the wheel about a grab axis parallel to the wheel axis and defining thereabout an orbit;

a conveyor adjacent the wheel having upper and lower elements defining parallel and vertically spaced upper and lower conveyor planes, and front and rear elements displaceable parallel to the planes therebetween and defining respective conveyor cells, the upper plane being generally tangent to the orbit of the grab axis;

drive means for advancing the front and rear elements of the conveyor in a transport direction with the rear elements moving underneath the wheel from an out of the way position with the respective cells open rearward in the transport direction to an up position rearwardly closing the respective cells; and means including structure operatively engaged between the grab, unfolder, and wheel for engaging a box with the grab and with the unfolder, for pivoting the grab and unfolder about the grab axis until the box is erected and an upper panel of the erected box engaged by the grab extends parallel to the upper conveyor plane but is spaced above the upper conveyor plane, and for synchronously pivoting the grab and unfolder about the grab axis after erecting the box and while rotating the wheel to maintain the upper panel of the box parallel to the upper conveyor plane until the upper panel lies generally on the upper conveyor plane, whereby the box can be released from the grab into a respective cell of the conveyor when the upper panel is on the upper conveyor plane.

4. The box-erecting system defined in claim 3 wherein the conveyor elements have upstream ends and the upstream end of the upper conveyor element is downstream in a conveyor transport direction from the upstream end of the lower conveyor element.

5. The box-erecting system defined in claim 3 wherein the structure pivots the folder inward toward the wheel axis as the rear element of the respective cell pivots into the up position.

6. The box-erecting system defined in claim 3 wherein the grab and the unfolder have elements defining respective support planes extending to immediately adjacent the grab axis.

7. The box-erecting system defined in claim 6 wherein the structure displaces the elements of the grab and unfolder temporarily into a position with the support planes defining an acute angle with each other.

8. The box-erecting system defined in claim 3 wherein the wheel is provided with a plurality of such grabs angularly equispaced about the wheel axis and adjacent each grab with a respective unfolder.

9. The box-erecting system defined in claim wherein the wheel is provided with a grab axle and with an unfolder axle in turn provided with respective arms carrying the grab and unfolder and provided with cranks constituting part of the structure.

10. The box-erecting system defined in claim 9 wherein the crank of one of the axles includes a tubular shaft and the crank of the other axle includes a shaft received in the tubular shaft and coaxial therewith.

11. The box-erecting system defined in claim 9 wherein the arms are axially displaceable on the respective axles.

12. The box-erecting system defined in claim 3 wherein the structure includes a cam fixed adjacent the wheel.

* * * * *